US007231861B1

(12) United States Patent
Gauny et al.

(10) Patent No.: US 7,231,861 B1
(45) Date of Patent: Jun. 19, 2007

(54) FIREARM MODIFICATION ASSEMBLY

(76) Inventors: Justin A. Gauny, 1885 Grinnell Ct., Virginia Beach, VA (US) 23454; Michael O'Neill, 418 SE. Frederick, Olympia, WA (US) 98501

( * ) Notice: Subject to any disclaimer, the term of this patent is extended or adjusted under 35 U.S.C. 154(b) by 425 days.

(21) Appl. No.: 11/012,318

(22) Filed: Dec. 16, 2004

(51) Int. Cl.
*B64D 1/04* (2006.01)

(52) U.S. Cl. ..... 89/1.4; 42/16; 42/72

(58) Field of Classification Search ..... 42/72, 42/16; 89/1.4
See application file for complete search history.

(56) References Cited

U.S. PATENT DOCUMENTS

| | | | | | |
|---|---|---|---|---|---|
| 1,402,459 | A | * | 1/1922 | Swebilius | 89/184 |
| 1,460,415 | A | * | 7/1923 | Gorton | 89/1.4 |
| 1,845,242 | A | * | 2/1932 | Coupland | 89/1.4 |
| 2,332,631 | A | * | 10/1943 | Gasser | 89/1.4 |
| 2,454,885 | A | * | 11/1948 | Robinson, Jr. | 42/16 |
| 2,832,165 | A | | 4/1958 | Ivy | |
| 2,845,001 | A | * | 7/1958 | Hillberg | 89/1.4 |
| 3,064,382 | A | | 11/1962 | Hill | |
| 3,224,653 | A | | 12/1965 | Packard | |
| 3,225,653 | A | * | 12/1965 | Packard | 89/1.4 |
| 3,774,498 | A | * | 11/1973 | Moller et al. | 89/1.4 |
| 4,052,926 | A | * | 10/1977 | Tollinger | 89/1.4 |
| 4,565,113 | A | * | 1/1986 | Bunning | 89/1.4 |
| 4,759,145 | A | * | 7/1988 | Volansky | 42/71.01 |
| 5,179,245 | A | | 1/1993 | Straka | |
| 5,551,179 | A | * | 9/1996 | Young | 42/16 |
| 6,019,024 | A | * | 2/2000 | Robinson et al. | 89/1.42 |
| 6,209,249 | B1 | * | 4/2001 | Borden | 42/16 |
| 6,311,603 | B1 | | 11/2001 | Dunlap | |
| 6,782,791 | B2 | * | 8/2004 | Moore | 89/1.4 |

* cited by examiner

*Primary Examiner*—Michelle Clement
(74) *Attorney, Agent, or Firm*—Richard C. Litman

(57) ABSTRACT

An assembly for modifying an automatic firearm such as a carbine rifle to relocate operation of the firearm charge handle. The assembly includes a fore-grip bracket, a drive rod movable in the foregrip bracket and attached to the charging handle release lever, and a cocking handle attached to the drive rod, the rod being attached to the charge handle for alternately releasing and latching the charge handle for clearing the firearm. In one embodiment, the foregrip bracket is attached to a removable rail attached to the foregrip by a jaw type device. Another embodiment attaches to the foregrip by attaching the foregrip bracket by screws. Another embodiment attaches to a foregrip having no rail by means of a groove cut in the grip, having a pair of spaced apertures into which hooks of foregrip mount, the bracket being held in place by a rod receiver and rotatable latch.

20 Claims, 10 Drawing Sheets

FIREARM MODIFICATION ASSEMBLY

BACKGROUND OF THE INVENTION

1. Field of the Invention

The present invention relates to firearms. More particularly, the present invention relates to an actuating rod assembly addition for operation of the charging handle of an automatic rifle or carbine rifle.

2. Description of the Related Art

A number of functions must be carried out by the user of an automatic firearm such as the Colt M4A1 5.56 carbine or the like. Among these functions include loading, unloading, clearing malfunction, doing "press checks" and locking the bolt. In order to carry out these operations, it is necessary to release the charging handle. As presently configured, the charging handle is gripped behind the trigger location, making it necessary to remove the firing hand from its grip position on the weapon to use that hand to release the charging handle while effectively maintain control of the rifle. This is undesirable since the "pistol grip" of the carbine or rifle makes an optimum control point on the weapon. As presently configured, it is effectively necessary to change hands on the firing grip in order to pull the charging handle, thus taking valuable time to carry out functions such as to reload the weapon and clear malfunctions. It would be desirable to provide a device attachable to such an automatic carbine or rifle which allows pulling back the charging handle using the other hand while maintaining that hand in a forward position such as at a forward grip, thus, allowing the trigger hand to remain on the trigger grip.

U.S. Pat. No. 2,832,165, issued Apr. 29, 1958, to Ivy, describes a bolt turning attachment for a rifle that relocates the function of the bolt towards the front grip.

U.S. Pat. No. 3,064,382, issued Nov. 20, 1962, to Hill, describes a gun/rifle having a modified location for an ejection mechanism.

U.S. Pat. No. 5,179,245, issued Jan. 12, 1993, to Straka, describes a rifle that relocates the functions of the bolt.

U.S. Pat. No. 6,311,603 B1, issued Nov. 6, 2001, to Dunlap, describes a modified charging handle for a gas-operated automatic firearm.

U.S. Pat. No. 3,224,653, issued Dec. 28, 1965, to Packard, describes a charging handle assembly for a gas-operated automatic firearm.

None of the above inventions and patents, taken either singly or in combination, is seen to describe the instant invention as claimed. Thus a firearm modification unit solving the aforementioned problems is desired.

SUMMARY OF THE INVENTION

The present invention is a unit or assembly for modifying a gas-operated automatic firearm such as a carbine or rifle so as to relocate operation of the charging handle of a firearm, such as a Colt M4A1 5.56 carbine, M-16, or "special purpose" rifles based thereon such as the U.S. SOCOM rifle having both front and rear pistol grips. The inventive unit has a foregrip bracket, a drive rod movable in the foregrip bracket and attached to the charging handle release lever, a cocking handle and a sling bracket. In one embodiment, the foregrip bracket is attached to a removable rail attached to the foregrip by a jaw type device. A sling bracket may be mounted on the rail behind the foregrip bracket. A variation of this embodiment attaches to the foregrip by removing the screws holding the bracket, and attaching the foregrip bracket of the device to the foregrip by means of the screws.

The foregrip bracket may also be attached to a "floating rail" of a "special purpose" carbine.

Another embodiment attaches to a foregrip having no rail by means of a groove cut in the grip, having a pair of spaced apertures into which hooks are inserted into the foregrip mount, the bracket being held in place by a rod receiver and rotatable retainer latch. The drive rod extends to the charging handle which is modified to engage the drive rod. A cocking handle allows back and forth movement of the charging handle and fits into a rear locking groove in the foregrip bracket by rotation.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an assembly for modifying a gas-operated automatic firearm such as a carbine or rifle so as to relocate operation of the charging handle of the firearm, such as a Colt M4A1 5.56 carbine or "special purpose" rifles based thereon such as the U.S. SOCOM rifle having both front and rear pistol grips.

Figure 1:
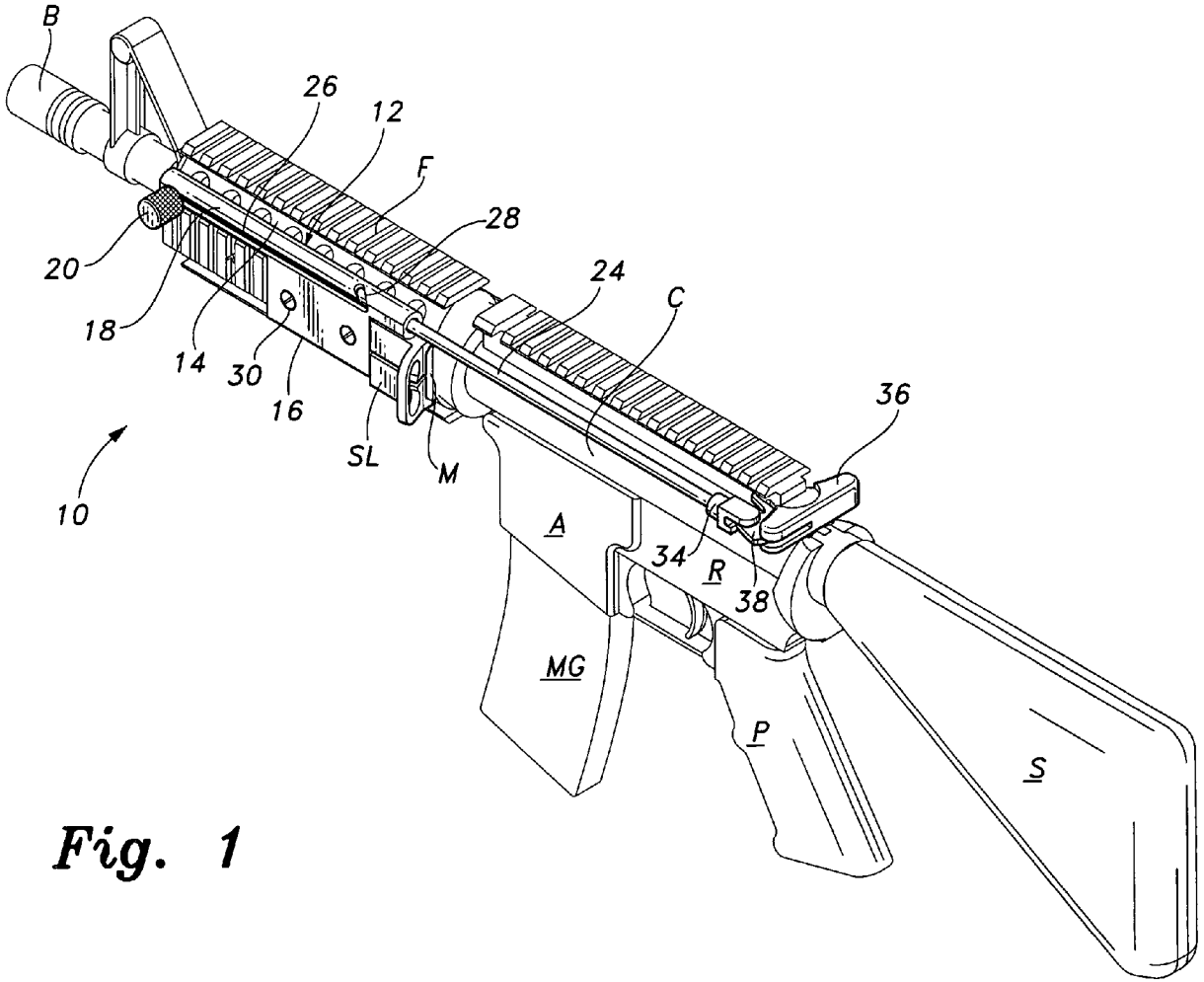
FIG. 1 is an environmental, perspective view of a firearm modified with the assembly according to the present invention.
Figure 2A:
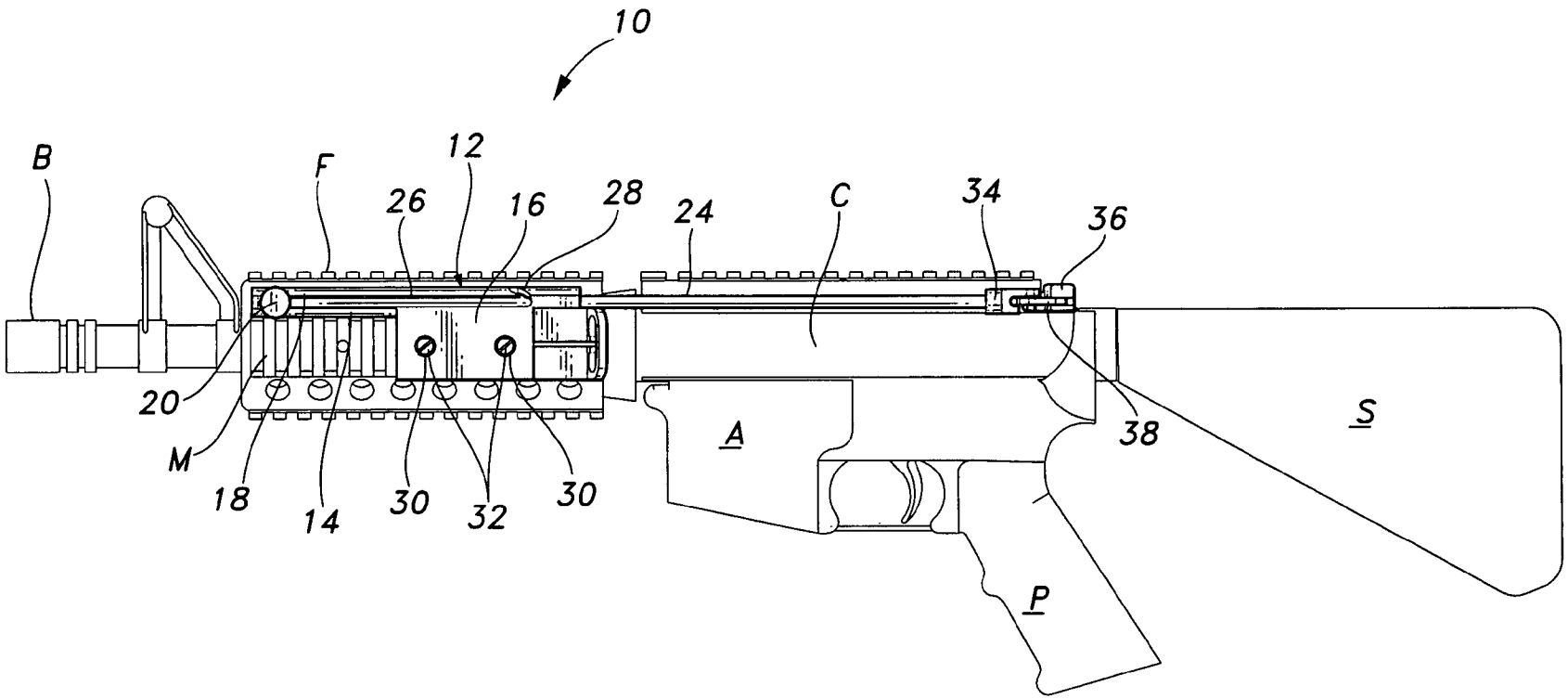
FIG. 2A is a side elevation view of the modified firearm of FIG. 1.

Referring to FIGS. 1 and 2A, there is shown a Colt M4A1 5.56 carbine rifle R having a stock S, a pistol grip P, an ammunition magazine receiver A having a magazine MG, a firing chamber C and a barrel B, foregrip F having a "Weaver" mounting rail M. Carbine charging handle operating system 10 includes a charging handle rod operation assembly 12 mounted between the foregrip F and the charging handle of carbine rifle R. Rod operation assembly 12 includes a foregrip bracket 14 having a rectangular foregrip bracket mount supporting bracket sleeve 18 located on mounting rail M. Also shown on rail M is a commercially available sling SL for mounting a carrying strap (not shown).

Cocking handle 20 may be grasped to move operating rod 24, supported coaxially within bracket sleeve 18, rearward to the unlatched, open charging handle position and back to the latched forward rest position along cocking handle rod connector operating slot 26. Operating rod 24 may be maintained in a rearward, open position by rotation of cocking handle 20 on rod 24 into cocking handle retaining notch 28. Foregrip bracket mount 16 has a pair of spaced mounting bores 30 having bracket mounting screws 32 which mount the bracket mount 16 over the mounting rail M and into foregrip F in existing threaded mounting bores.

Operating rod 24 is connected at its rear end to charging handle 36 by means of rod connector 34 operating on charging handle release lever 38. Charging handle release lever 38 is spring loaded within charging handle 36 and has a hook 39 (see FIG. 3A) which must be released from the rifle R in order to allow rearward travel of charging handle 36.

Figure 3A:
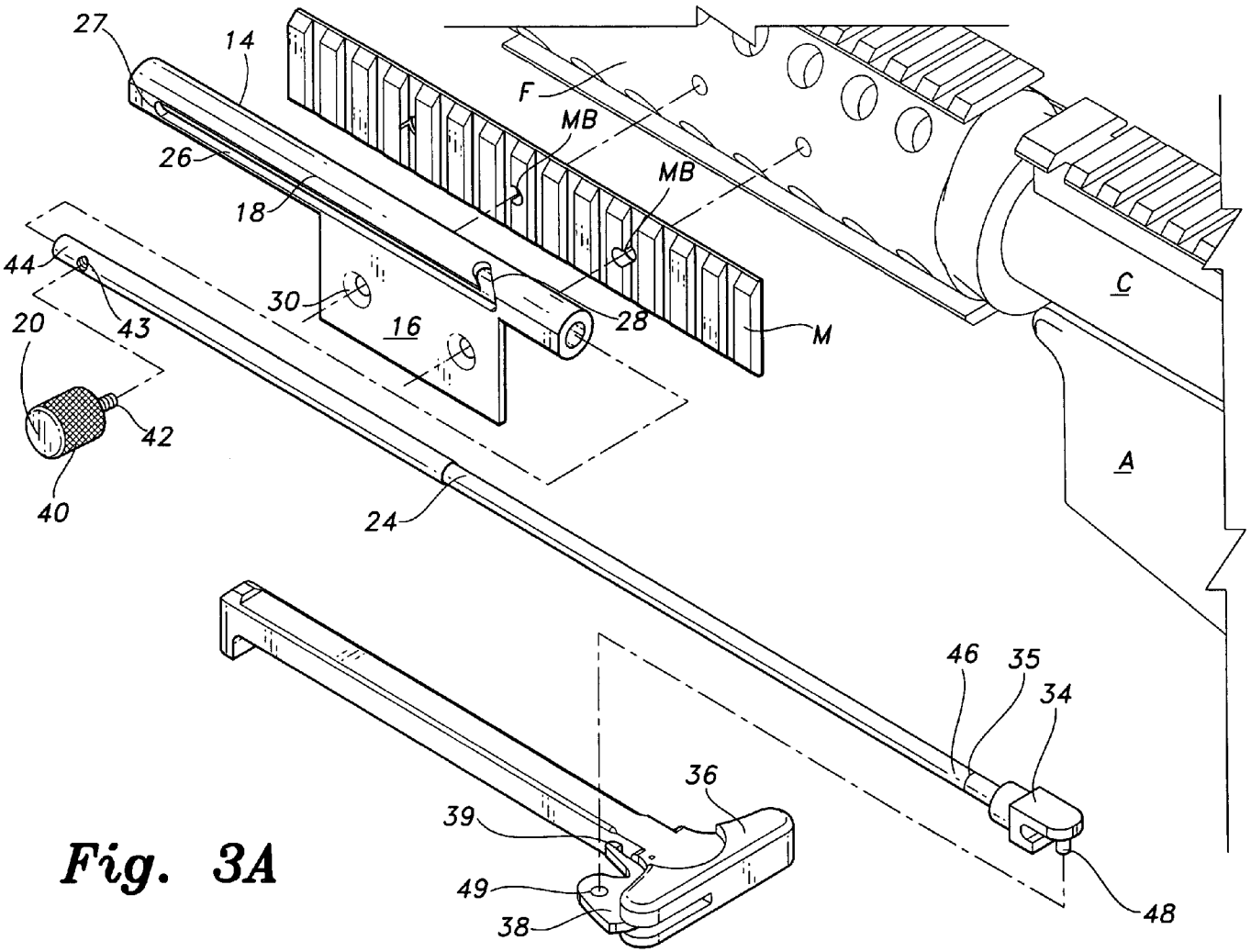
FIG. 3A is an exploded view of the firearm modification assembly of FIG. 1.
Figure 8:
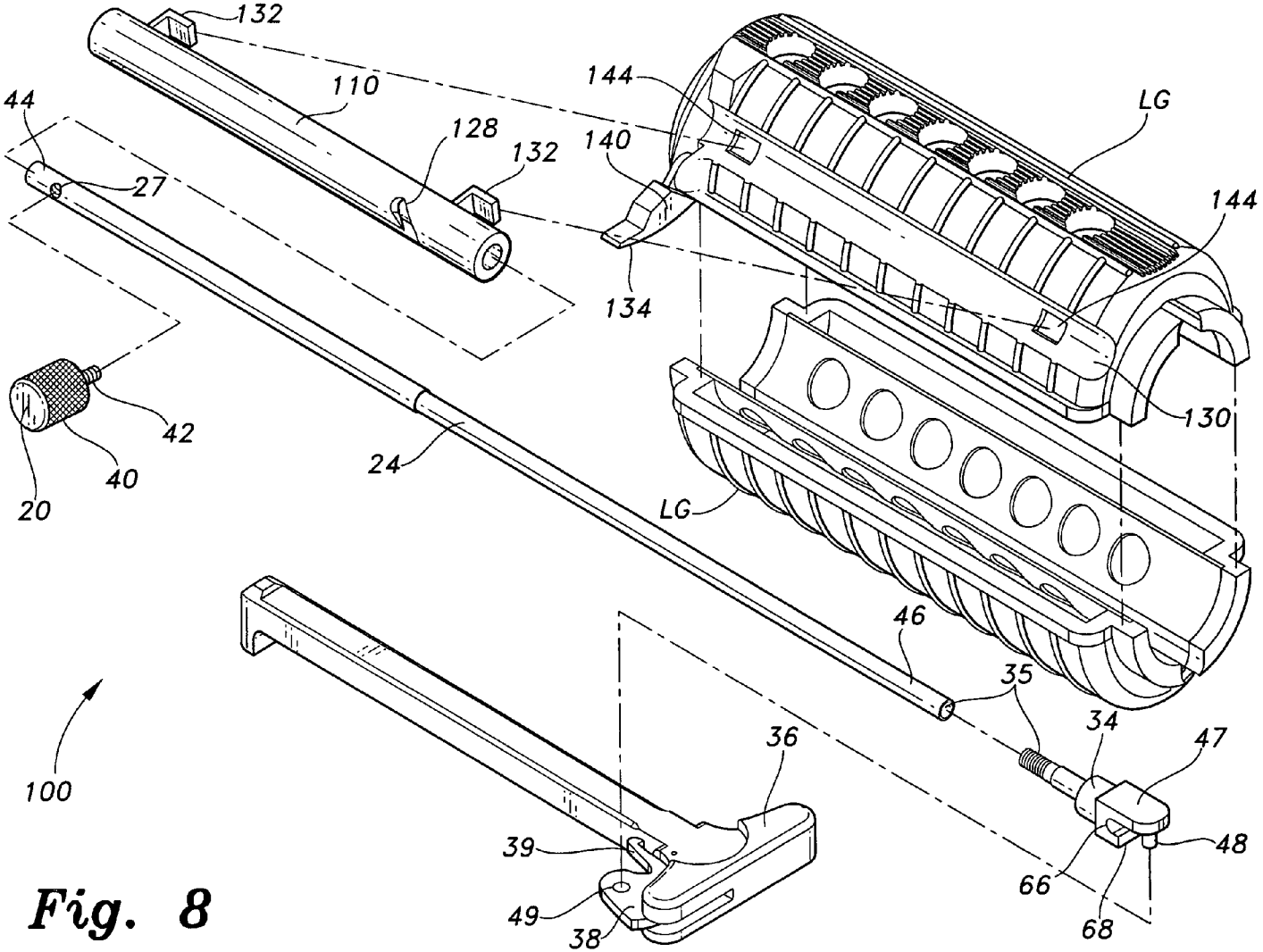
FIG. 8 is an exploded view of the firearm modification of FIG. 5.

Referring to FIG. 3A there is shown an exploded view of the elements of charging handle operating system 10 as shown in FIGS. 1 and 2A. Mounting rail M is attached between foregrip F and foregrip bracket mount 16 by screws 31 (see FIG. 2A) extending through mounting bores MB. Operating rod 24 has a front portion 44 and a rear portion 46 to which is attached rod connector 34 by means of a rod connector rotatable operating rod connection 35 such as the concentric screw 33, allowing relative rotation of rod 24 and rod connector 34 (See FIG. 8). Pin 48 extends downward from the remote end of rod connector 34 which is inserted into pin receiving bore 49 in spring loaded charging handle release lever 38 of charging handle 36. The conventional charging handle release lever is modified by boring receiving bore 49 therethrough. Cocking handle 20 has a knurled grip 40 (see FIG. 1) and a cocking handle connecting rod 42 for connection with operating rod 24 by means of connecting rod receiver bore 43 within operating rod front end portion 44. The cocking handle rod connector operating slot 26 receives cocking handle connecting rod 42 through the exposed side of bracket sleeve 18 and allows movement of operating rod 24 between a forward point 27 and a rearward point at which rod 24 may be rotated by cocking handle 20 with cocking handle connecting rod 42 rotating into retaining notch 28.

Figure 2B:
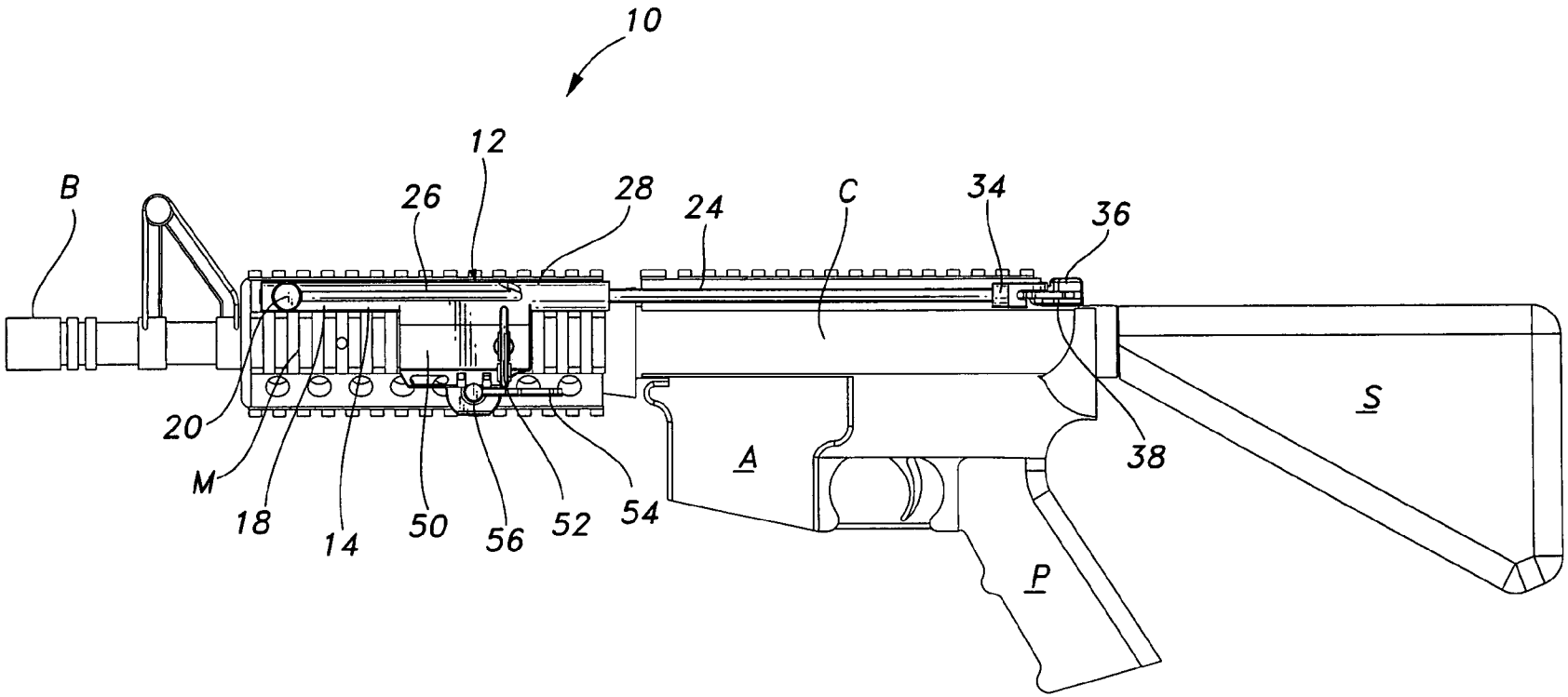
FIG. 2B is a side elevation view of a firearm modified with a variation on the assembly according to FIG. 1.
Figure 3B:
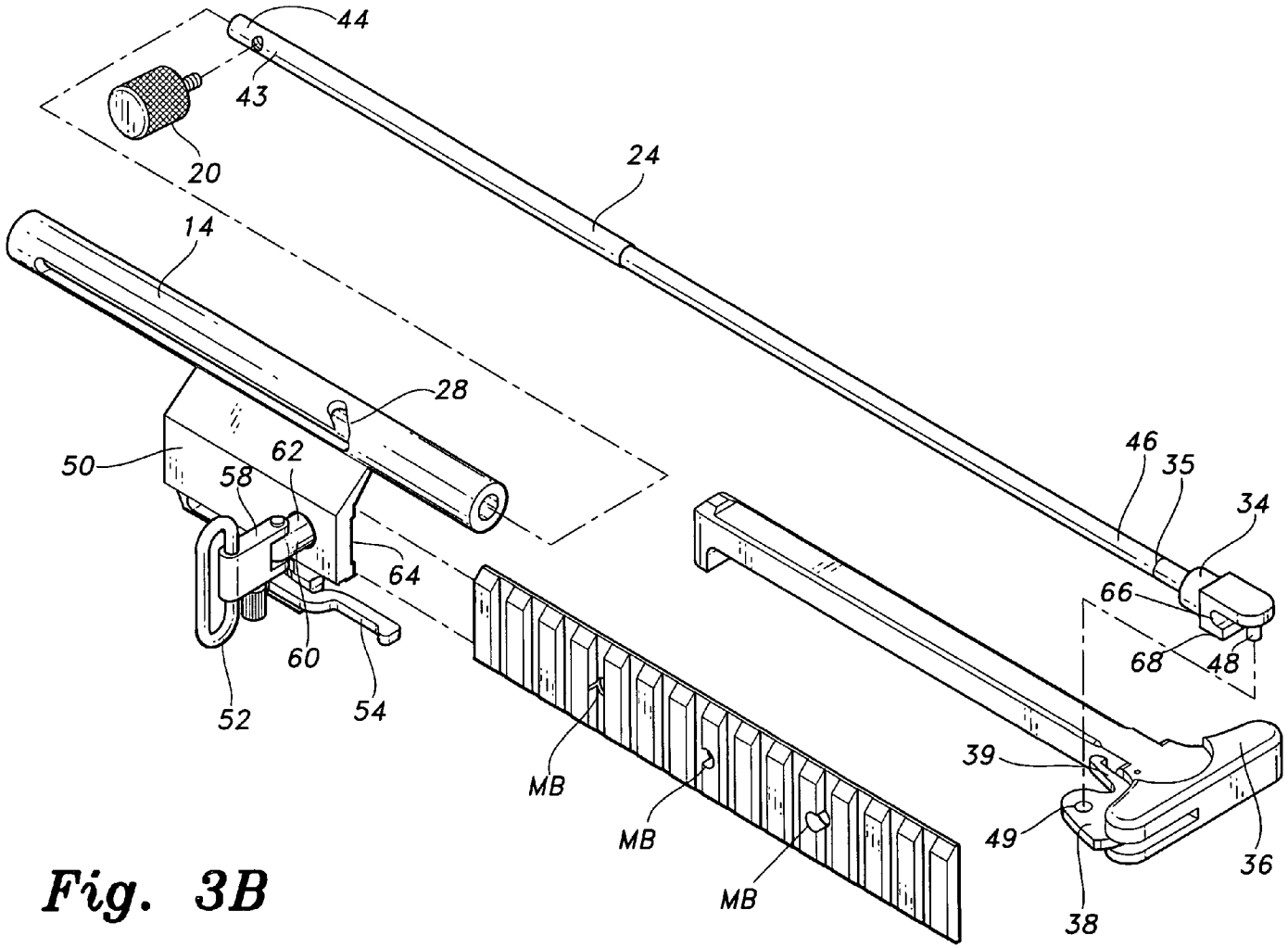
FIG. 3B is an exploded view of the firearm modification assembly of FIG. 2B.

Referring to FIGS. 2B and 3B there is shown a variation of the embodiment of FIGS. 1 and 2*a* as described above, having a Tri-lock rail mount 50 as a support for bracket sleeve 18 forming foregrip bracket 14. The Tri-lock rail mount 50 is commercially available and is useful for mounting sling 52 for a sling strap or the like. Bracket sleeve 18 is welded or otherwise attached to the rail mount 50. Rail mount 50 has a locking lever 54 attached to lever rotator pin 56 and which may be rotated between a locked, horizontal position, locking rail mount 50 on mounting rail M, to an unlocked vertical position which allows removal from rail M. As shown, sling rotatable attaching mechanism 58 allows for rotatable mounting to sling rail mount attachment rod 60 which loosely extends through sling mount receiver bore 62, allowing for multiple degrees of freedom for sling 52 relative to rail mount 50.

Figure 5:
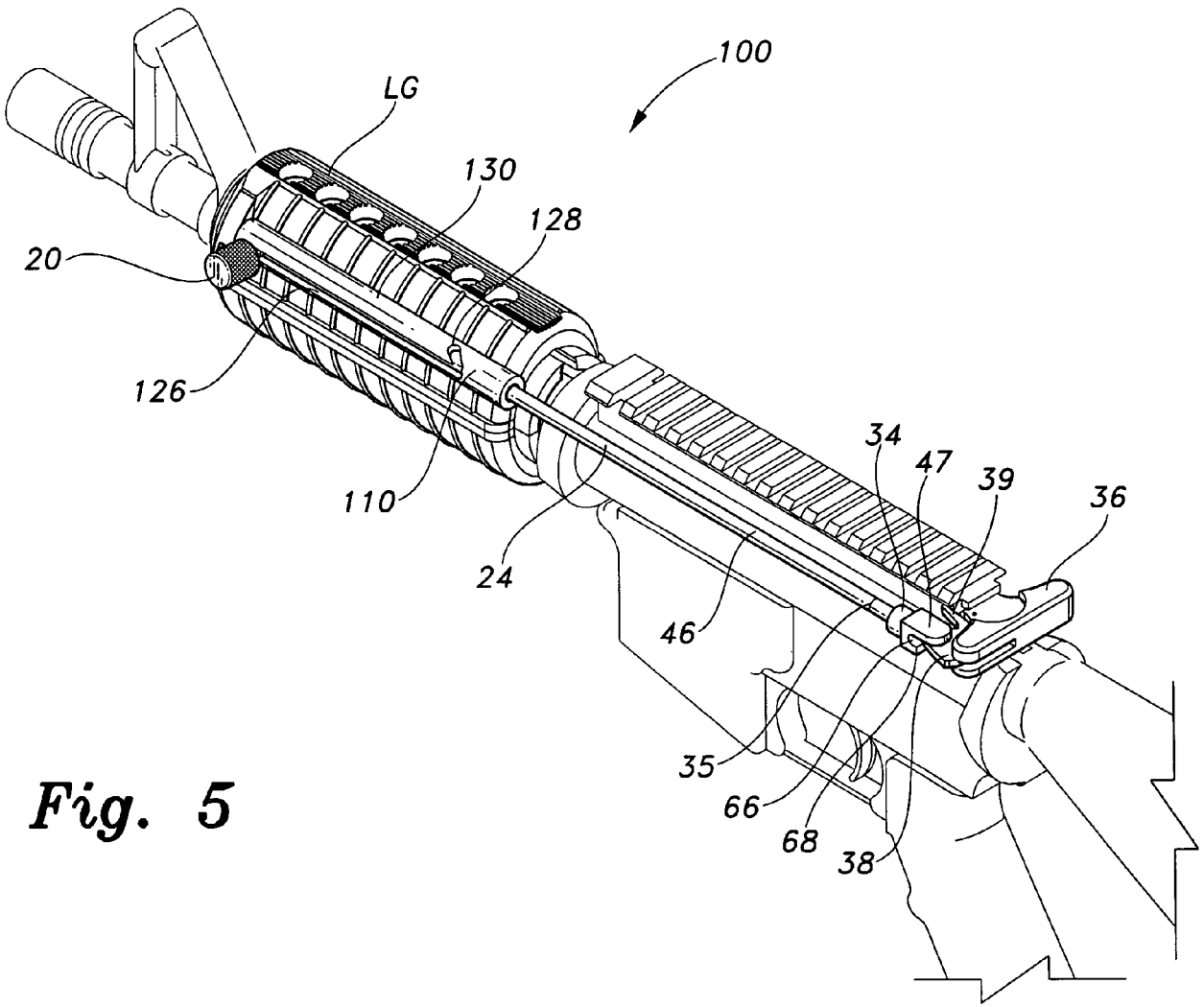
FIG. 5 is an environmental, perspective view of a firearm modified with another embodiment of the assembly according to the present invention.
Figure 6:
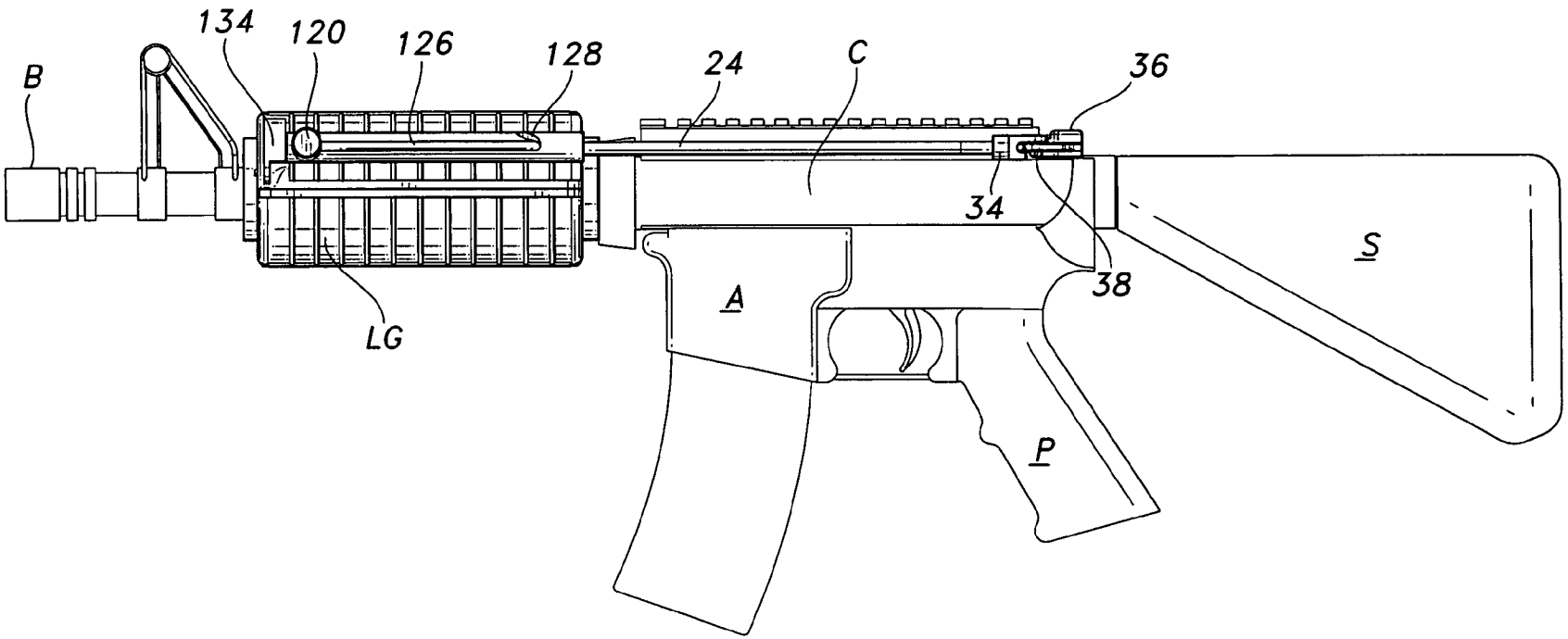
FIG. 6 is a side elevation view of the firearm modification of FIG. 5.

Tri-lock rail mount 50 has a rear rail mount grasping portion 64 which fits over mounting rail M, engaging rail M upon tightening (upward rotation) of rail mount lever 54 and releasing from rail M upon loosening (downward rotation) of rail mount lever 54. Rod connector 34 is rotatably attached to operating rod 24 at rear portion 46 by rotatable rod connection 35 and has an upper extending flat 47 bearing rod connector pin 48 directed vertically downward therefrom, a lower plate 68 extending outward to form a rod connector receiving slot 66 fitting over charging handle release lever 38 when rod connector pin 48 is inserted into charging handle release lever pin receiving bore 49 to form an assembly (see FIG. 5).

Figure 4:
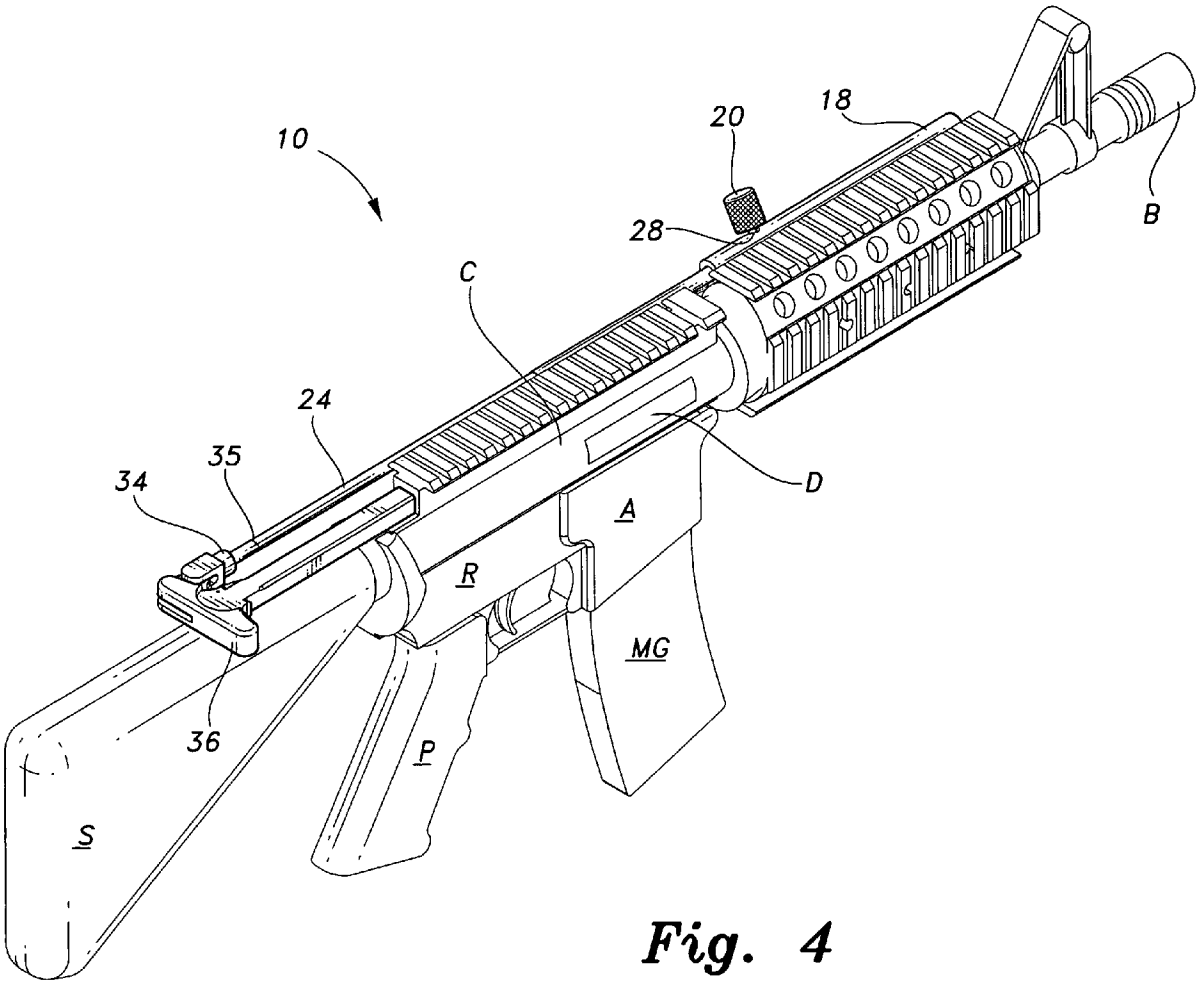
FIG. 4 is a right rear perspective view of the firearm modified with the assembly according to FIG. 1.
Figure 7:
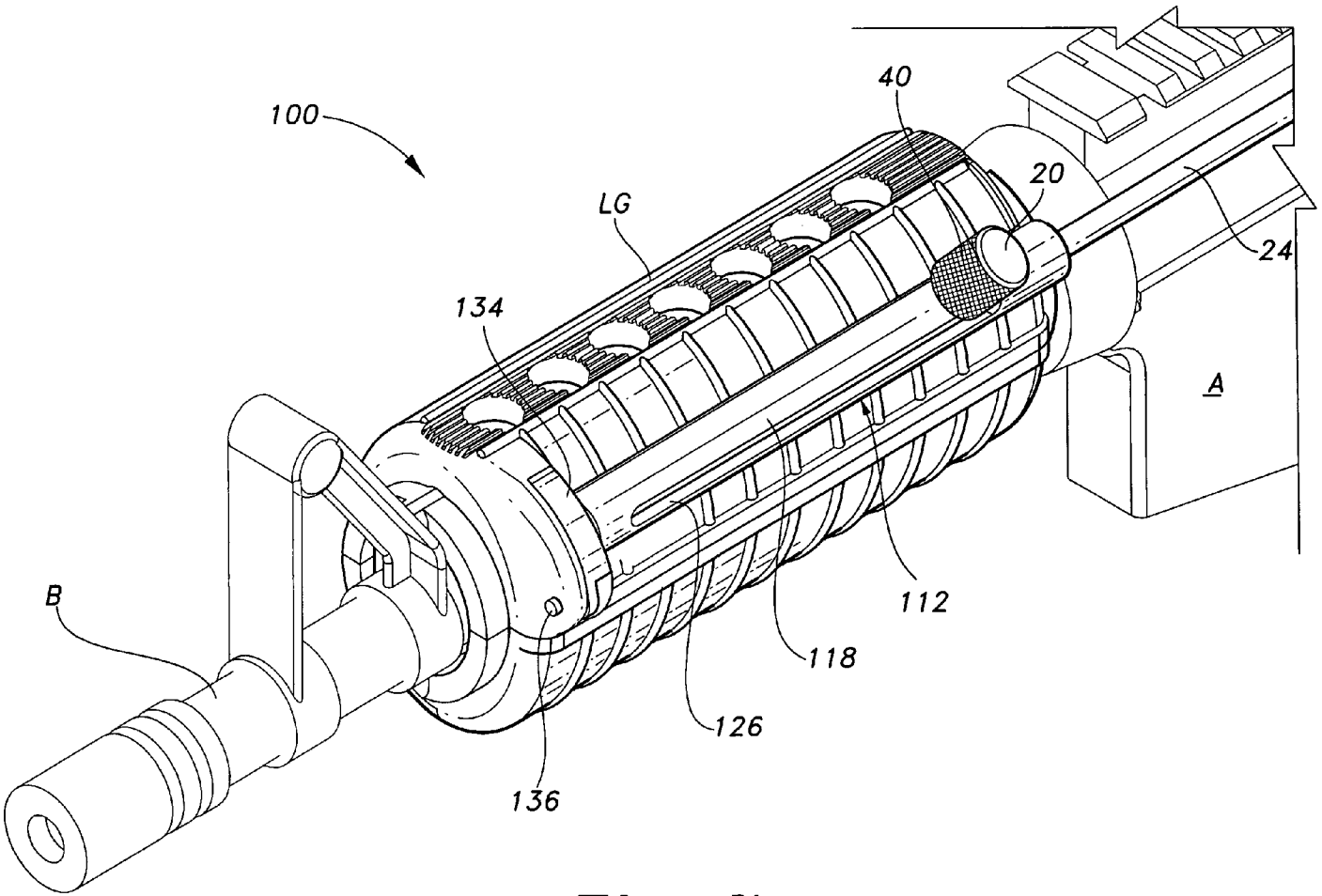
FIG. 7 is a front detail perspective view of the foregrip and forward portion of the modified assembly of FIG. 5.

Referring to FIG. 4, there is shown a rear right hand perspective view of the rifle of FIG. 1 with the charge handle 36 in the open, rear position. As is seen, operating rod 24 is in its rear drawn position with cocking handle 20 drawn to the rear of slot 26 in bracket sleeve 18 and rotated into retaining notch 28. (Also see FIG. 7 where this position of cocking handle 20 is shown) In this view an ammunition magazine MG is mounted in ammunition magazine receiver A. The ammunition casing discharge aperture D of firing chamber C is shown on the right side of the rifle R and it can be seen that with the charging handle 36 in the rear, open position, allows access to the user to dislodge jammed ammunition with the left hand. The inventive system allows the entire procedure of unlatching and pulling back the charging handle 36 by pulling on cocking handle 20 with the left hand, reaching with the left hand to clear the firing chamber C through discharge aperture D, and returning the charging handle to the forward, locked position by pushing forward on the cocking. handle 20, the user's right hand remaining on the pistol grip P through this entire procedure.

Referring to FIGS. 5-8, there is shown another embodiment of the present invention wherein a lamp mount type foregrip LG (lamp not shown) having no rail mount is employed on a firearm. Foregrip LG has a lengthwise attachment groove 130 for receiving operating rod cylindrical sleeve 110. Cylindrical sleeve 110 is similar to bracket sleeve 18 of the first embodiment as described above, defining lengthwise groove 126 extending through the wall thereof and ending in a cocking handle retaining notch 128. Cylindrical sleeve 110 also has an attaching hook 132 near each end on about the opposite side thereof from groove 126, attaching hooks 132 fitting into attaching hook receiving apertures 144 near opposite ends of foregrip attachment groove 130. A rod retainer latch 134 swivels around a latch pin 136 from an open position extending radially outward from the forward end portion of foregrip LG and is rotatable to a closed position conforming with the generally cylindrical shape of foregrip LG.

A conventional lamp foregrip LG may be modified to form the attachment groove 130 attaching hook receiving apertures 144 and rod retainer latch 136. Upon assembly, the attaching hooks 132 on rod holding sleeve 110 are inserted through apertures 144 through the wall of groove 130 in foregrip LG and the sleeve 110 slid to the rear, securing hooks 132 within the inner wall of groove 130. Rod retainer latch 134 is then swung from an open position (see FIG. 8) to a closed position (see FIG. 7) with jamb portion 140 acting as a securing jamb for sleeve 110 and the forward end portion 44 of operating rod 24.

The operating rod 24, cocking handle 20, rod connector 34 and charging handle 36 are identical to those of the first embodiment of FIGS. 1-4 above and operate in an identical manner thereto and a full description is provided in the corresponding detailed description above.

The operating rod 24 may be made of differing lengths to fit various versions of the firearm shown in the Figures. Also, a special version of the firearm has a front mounted trigger grip in place of the foregrip shown. This special version provides for a mounting rail separate from the foregrip known as a "floating rail" system. The Tri-lock rail mount 50 as described above may be employed to on the "floating rail" system to support the bracket sleeve 18 in the same manner.

The inventive charging handle operating system 10 of the invention may be applied to the "floating rail" mount and charging handle by providing an operating rod 24 of the proper length.

The components of the inventive system may be made of appropriate material such as steel, aluminum, titanium, stainless steel, hard plastic, or other appropriate alloys.

It is to be understood that the present invention is not limited to the embodiments described above, but encompasses any and all embodiments within the scope of the following claims.

We claim:

1. A charging handle operation system for a firearm comprising:

a foregrip bracket having a mount for attachment to the foregrip of a firearm;

said foregrip bracket having a bracket sleeve connected to and supported by said foregrip bracket mount;

an operating rod having a front end portion and a rear end portion, and coaxially extending through and rearward of said bracket sleeve; and a rod connector connected to said rear end portion of said operating rod for connection with a charging handle;

a cocking handle connected to said operating rod at said front end portion thereof;

said bracket sleeve of said foregrip bracket defining an elongated cocking handle operating slot along the length thereof opposite said foregrip receiving said cocking handle for movement of said operating rod between a rest position and a rearward position;

whereby, upon the user grasping said cocking handle by the user's foregrip hand and pulling said cocking handle to said rearward position, said rod connector unlatches and moves the charging handle to a rear, open position; and whereby, upon the user grasping and pushing said cocking handle by the user's foregrip hand to said forward position, said rod connector moves the charging handle to the forward, latched, closed position.

2. The charging handle operating system of claim 1, further comprising a cocking handle connecting rod connecting said cocking handle and said operating rod, said connecting rod being dimensioned such as to travel within said elongated operating slot in said bracket sleeve.

3. The charging handle operating system of claim 1, said bracket sleeve defining a forward end of said slot and a rearward handle retaining notch at a rear end of said slot, said operating rod being rotatable by said cocking handle from said slot into said retaining notch for maintaining said charging handle in a rear, open position, said operating handle being connected for rotation to said rod connector.

4. The charging handle operating system of claim 3, said rod connector having an upper pin connector support plate, a rod connector pin depending from the rear portion of said pin connector support plate, and a lower rod connector plate, said upper pin connector support plate and said lower rod connector plate defining a rod connector receiving slot.

5. The charging handle operating system of claim 4, said charging handle having a charging handle release lever defining a pin receiving bore for receiving said rod connector pin of said rod connector.

6. The charging handle operating system of claim 5, said release lever being spring loaded within said charging handle, said release lever having a release lever hook engaging said firearm, said release lever being opened upon said operating rod and said rod connector being moved rearward from the forward, rest position.

7. The charging handle operating system of claim 1, said foregrip bracket being in the general shape of a rectangular flat; said bracket defining bores therethrough receiving mounting screws for mounting to said foregrip.

8. The charging handle operating system of claim 1, said foregrip having a mounting rail extending lengthwise thereon, said foregrip bracket being mounted by said mounting screws to said mounting rail.

9. The charging handle operating system of claim 8, further comprising a rail mounted sling.

10. The charging handle operating system of claim 1, said foregrip having a mounting rail extending lengthwise thereon, said foregrip bracket being mounted on said mounting rail by a Tri-lock rail mount having a sling and a lever operated rail mount grasping portion.

11. The charging handle operating system of claim 1, the firearm having a pistol grip, and whereby said operating rod and said charging handle is moveable between the forward rest position and the rearward open position while the user's pistol grip hand remains on the pistol grip.

12. The charging handle operating system of claim 1, the firearm, said foregrip being a pistol grip, said firearm having a floating mounting rail, said foregrip bracket being mounted on said mounting rail by a Tri-lock rail mount having a sling and a lever operated rail mount grasping portion.

13. A charging handle operation system for a firearm comprising:

a cylindrical foregrip having a lengthwise elongated groove therein, said groove defining spaced attaching hook receiving apertures, an operating rod sleeve having spaced attaching hooks so configured as to be inserted into said spaced attaching hook receiving apertures for slideable locking of said operating rod sleeve within said groove;

a rod retainer latch rotatable attached to said cylindrical foregrip at a point immediately forward of said elongated groove and swingable between a radial open position and a closed foregrip conforming position, said rod retainer latch having a jamb portion locking said operating rod sleeve within said groove upon swinging said rod retainer latch into said foregrip conforming position;

an operating rod having a front end portion and a rear end portion, and coaxially extending through and rearward of said operating rod sleeve;

a rod connector connected to said rear end portion of said operating rod for connection with a charging handle; and a cocking handle connected to said operating rod at said front end portion thereof;

said bracket sleeve of said foregrip bracket defining an elongated cocking handle slot operating along the length thereof opposite said foregrip receiving said cocking handle for movement of said operating rod between a rest position and a rearward position;

whereby, upon the user grasping said cocking handle by the user's foregrip hand and pulling said cocking handle to said rearward position, said rod connector unlatches and moves the charging handle to a rear, open position; and whereby, upon the user grasping and pushing said cocking handle by the user's foregrip hand to said forward position, said rod connector moves the charging handle to the forward, latched, closed position.

14. The charging handle operating system of claim 13, further comprising a cocking handle connecting rod connecting said cocking handle and said operating rod, said connecting rod being dimensioned such as to travel within said elongated operating slot in said sleeve.

15. The charging handle operating system of claim 13, said sleeve defining a forward end of said slot and a rearward handle retaining notch at a rear end of said slot, said operating rod being rotatable by said cocking handle from said slot into said retaining notch for maintaining said charging handle in a rear, open position, said operating handle being connected for rotation to said rod connector.

16. The charging handle operating system of claim 15, said rod connector having an upper pin connector support plate, a rod connector pin depending from the rear portion of said pin connector support plate, and a lower rod connector plate, said upper pin connector support plate and said lower rod connector plate defining a rod connector receiving slot.

17. The charging handle operating system of claim 13, the firearm having a pistol grip, and whereby said operating rod and said charging handle is moveable between the forward rest position and the rearward open position while the user's pistol grip hand remains continuously on the pistol grip.

18. A charging handle operation system for a firearm comprising:

a foregrip having a bracket sleeve longitudinally connected thereto;

an operating rod having a front end portion and a rear end portion, and coaxially extending through and rearward of said sleeve; and a rod connector connected to said rear end portion of said operating rod for connection with a charging handle;

a cocking handle connected to said operating rod at said front end portion thereof;

said bracket sleeve of said foregrip bracket defining an elongated cocking handle operating slot along the length thereof opposite said foregrip receiving said cocking handle for movement of said operating rod between a rest position and a rearward position;

whereby, upon the user grasping said cocking handle by the user's foregrip hand and pulling said cocking handle to said rearward position, said rod connector unlatches and moves the charging handle to a rear, open position; and whereby, upon the user grasping and pushing said cocking handle by the user's foregrip hand to said forward position, said rod connector moves the charging handle to the forward, latched, closed position.

19. The charging handle operating system of claim 18, further comprising a cocking handle connecting rod connecting said cocking handle and said operating rod, said connecting rod being dimensioned such as to travel within said elongated operating slot in said bracket sleeve.

20. The charging handle operating system of claim 19, said sleeve defining a forward end of said slot and a rearward handle retaining notch at a rear end of said slot, said operating rod being rotatable by said cocking handle from said slot into said retaining notch for maintaining said charging handle, in a rear, open position, said operating handle being connected for rotation to said rod connector, said rod connector having an upper pin connector support plate, a rod connector pin depending from the rear portion of said pin connector support plate, and a lower rod connector plate, said upper pin connector support plate and said lower rod connector plate defining a rod connector receiving slot.

* * * * *